United States Patent [19]

Davis

[11] 4,241,684

[45] Dec. 30, 1980

[54] TILLER STEERING LOCK

[76] Inventor: Dan B. Davis, 5205 Belmore Ave., Montreal, Quebec, Canada, H4V 2C7

[21] Appl. No.: 44,576

[22] Filed: Jun. 1, 1979

[51] Int. Cl.[3] ..... B63H 25/52

[52] U.S. Cl. ..... 114/144 R; 24/134 P; 74/489; 74/532; 114/172

[58] Field of Search ..... 114/144 R, 170, 172, 114/218; 24/132 R, 134 P, 134 L, 134 R, 134 KB; 74/489, 527, 532

[56] References Cited

U.S. PATENT DOCUMENTS

| | | | |
|---|---|---|---|
| 2,472,442 | 6/1949 | Schueler | 74/489 |
| 3,845,523 | 11/1974 | Mayberry | 24/134 P |
| 4,080,918 | 3/1978 | Bonhard | 114/172 |

*Primary Examiner*—Sherman D. Basinger
*Attorney, Agent, or Firm*—Larson, Taylor and Hinds

[57] ABSTRACT

A quick release locking device to hold a tiller arm of a sailing boat is disclosed. The device allows a helmsman to engage or disengage the locking mechanism almost instantaneously with one hand, and also allows the tiller arm to be locked in any position. The device comprises two rope attachment anchors, one at each side of the boat, positioned an equi-distance from the rudder axis, rope locking device located on the underside of the tiller arm which includes two opposing cam detents to positively grip the rope, flexible rope tautly strung between the two attachment anchors passing through the rope locking device, quick release control lever located on the tiller arm and a connection between the control lever and the rope locking device such that depression of the control lever releases the rope from the locking device allowing the tiller arm to rotate as desired, and release of the control lever grips the rope in the locking device preventing the tiller arm from rotating.

5 Claims, 3 Drawing Figures

TILLER STEERING LOCK

This invention relates to sailing boats which have tillers and more particularly to a quick release locking device to hold a tiller arm of a sailiing boat in any desired position.

When sailing in small boats the helmsman often finds it necessary to let go of the tiller in order to adjust the main sheet or assist in positioning jib or spinnaker sheets, and unless he has some method of holding the tiller arm, the rudder tends to swing so the boat heads up into the wind. Thus, there is a need for a device which will retain the tiller arm and hence the rudder in any one position, but which may easily be released so that the helmsman can steer the boat as he desires. Tiller holding attachments have been known for a long time, for instance, U.S. Pat. No. 177,590 issued to Thomas in 1876 shows a complex rope device which holds a tiller arm in one position. Such a system may partially fulfill the need but has one basic disadvantage in that it requires a special screw to tighten down and hold the rope around the tiller and prevent the tiller from moving. The tightening or loosening of this set screw would probably require two hands and would take some time. Furthermore, the set screw would likely damage the rope. In many situations a helmsman does not have time to unscrew a set screw and needs an instantaneous release device. Furthermore, in small boats a helmsman often has one hand on the main sheet and the other on the tiller arm, so the release mechanism should preferably be operated by one hand.

Another concept showing a tiller arm holder for a small boat is that shown by Young in U.S. Pat. No. 3,279,410. This device comprises a rod and spring positioned across the boat beneath the tiller arm. The tiller is lowered so tht a detent beneath the tiller arm fits between the coils of the spring. Thus the device only works when the tiller arm is in its lowest position. Furthermore, the spring and rod can cause a tripping hazard in the cockpit of a boat. The device does not give infinite positioning of the tiller without rotating the spring, and this again becomes somewhat difficult to do in a small boat when one has only one hand for the tiller.

I have now found there is a need for a quick release tiller locking device that can be operated by one hand so that a helmsman may keep one hand on the main sheet or supporting himself in the boat.

The present invention provides a tiller locking device which positively locks the tiller arm in any position of its movement and is difficult to disengage accidentally. Furthermore, small course corrections may be accomplished because the locking device locks the tiller arm in any location. The locking device may be used to keep the tiller arm from moving when the boat is unattended and furthermore the locking device is far enough back so that it does not cause interference with a person in the cockpit of a boat.

The present device also provides a locking device for a tiller arm to relieve the helmsman from continuously fighting the tiller in heavy winds or gust wind conditions. The locking device grips the rope and prevents the tiller arm from moving in either direction. More force on the tiller arm only results in a tighter gripping of the rope. Furthermore, the locking device does not damage the rope as in older types of tiller steering locks.

The present invention provides a quick release locking device to hold a tiller arm of a sailing boat in any desired position, the tiller arm connected at one end to a rudder rotating about a rudder axis, the device comprising two roper attachment means, one at each side of the boat, positioned an equidistance from the rudder axis, rope locking means located on the underside of the tiller arm, flexible rope tautly strung between the two attachment means passing through the rope locking means, quick release control lever located on the tiller arm, and connection means between the control lever and the rope locking means, such that depression of the control lever releases the rope from the rope locking means allowing the tiller arm to be rotated as desired and release of the control lever grips the rope in the rope locking means preventing the tiller arm from rotating.

In one embodiment the rope locking means includes two opposing cam detents, one cam detent presses the rope against a restraining surface to grip the rope and prevent the tiller arm from moving in one direction, the other cam detent presses the rope against the restraining surface to grip the rope and prevent the tiller arm from moving in the other direction, spring means between the two cam detents forcing each cam detent to press and grip the rope against the restraining surface, and wherein the connection means joins the spring means to the control lever such that depression of the control lever removes the cam detents from pressing and gripping the rope, thus allowing the restraining surface to slide freely over the rope.

In another embodiment the device includes a locking pin for holding the control lever in a depressed position, such that the rope locking means is free to slide on the rope. In a still further embodiment the connection means includes a wire cable attached between the cam detents and the control lever. The rope of the present invention is preferably made from nylon which allows some stretch to assist in keeping the rope taut.

In drawings which illustrate the embodiments of the invention,

Figure 1:
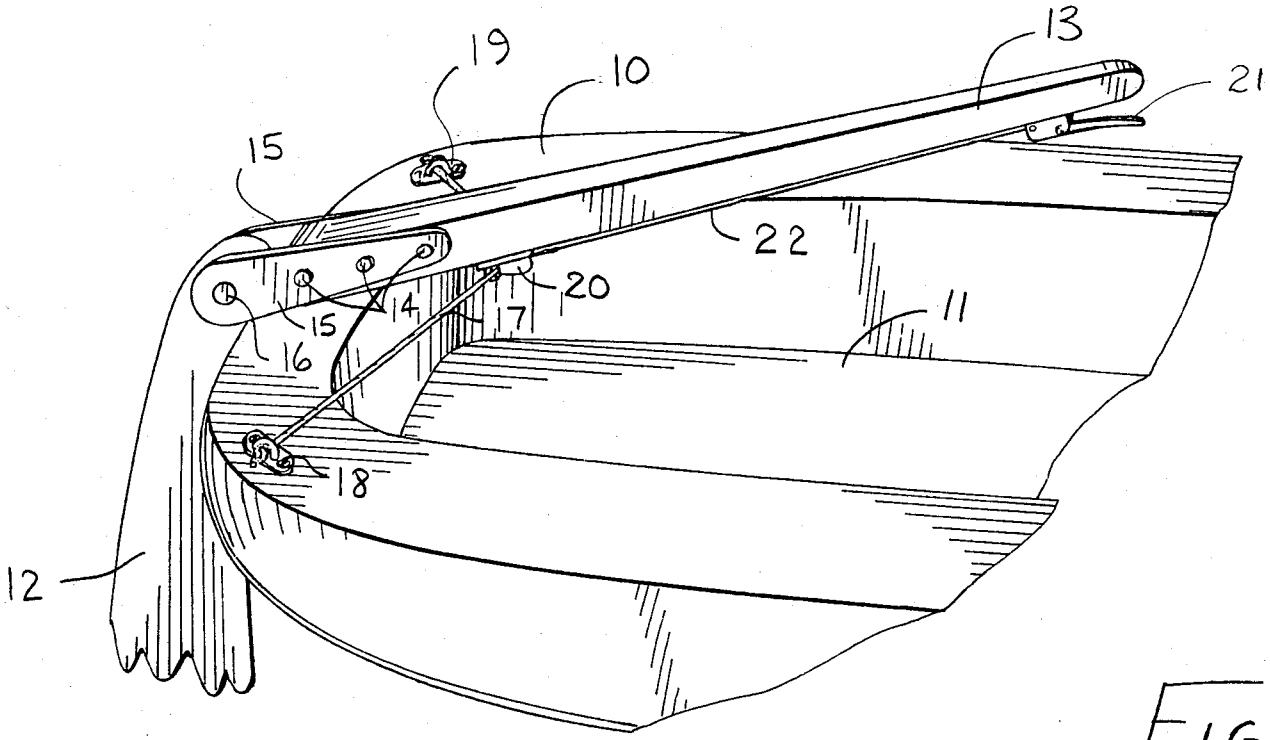
FIG. 1 is an isometric view of the stern of a sailing boat showing the rudder, tiller arm, and the locking device of the present invention.

Referring now to the drawings, FIG. 1 shows a stern portion 10 of a sail boat having a cockpit 11 therein. A rudder 12 is attached at the stern of the sail boat 10 and is pivoted about a rudder axis (not shown) by a tiller arm 13. The tiller arm 13 is attached to the rudder 12 by bolts 14 through cheek plates 15 and by a pivot pin 16 which allows the tiller arm 13 to be raised and lowered, so that the height of the tiller arm 13 can be varied as desired by the helmsman.

The locking arrangement for the tiller arm 13 includes a rope 17 tautly strung transversely in the boat 10 between two fixed eyes 18,19, located one on each side of the boat and spaced equi-distance from the rudder axis. The rope 17 is stretched between the two fixed eyes 18,19 and forward to engage the rope locking device 20 on the underside of the tiller arm 13. A quick release control lever 21 is positioned at the end of the tiller arm 13 away from the rudder 12 and a wire cable 22 connects the control lever 21 to the rope locking device 20.

Figure 2:
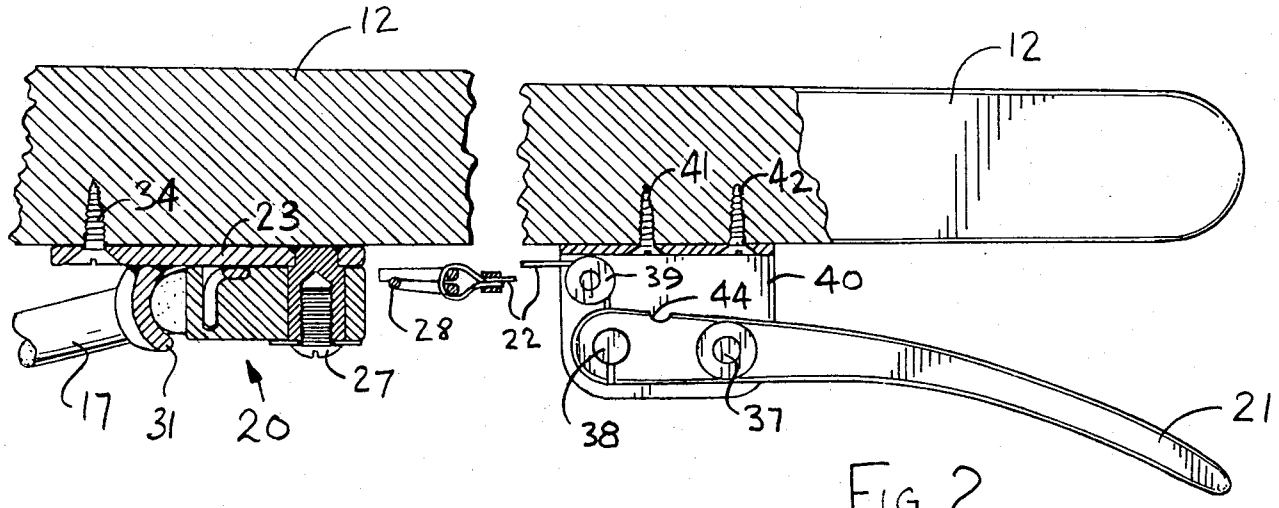
FIG. 2 is a sectional elevation through the tiller arm shown in FIG. 1.
Figure 3:
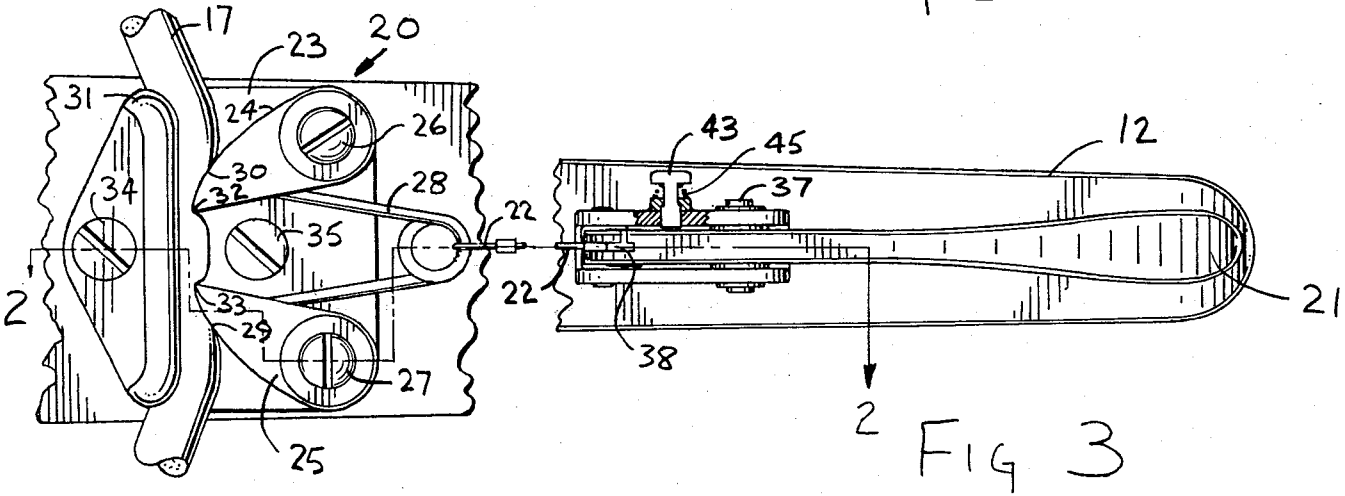
FIG. 3 is an underneath plan view of the tiller arm shown in FIG. 1.

Referring now to FIGS. 2 and 3, the rope locking device 20 includes a mounting plate 23 on which are mounted two cam detents 24,25 rotating about pivot 26 and 27 and urged to rotate outwardly by a strong spring 28. The cam detents 24,25 have curved surfaces 29 and 30 acting in a wedging fashion allowing the cam detents 24,25 to become deeply and firmly embedded in the rope 17 which in turn is guided and supported by a smooth curved restraining surface 31 integral with the mounting plate 23. The smooth surface 31 ensures that wear on the ropes 17 is at a minimum even though there may be relative movement during normal steering. Once the cam detents 24,25 are embedded in the rope 17 the slightest tendency of the tiller to move in either direction under the force of the rudder 11 causes the rope 17 to engage one or other of the sharp tips 32,33 of the cam detents 24,25 rotating that particular cam detent even further and causing the sharp tip 32,33 to embed itself more deeply in the rope 17 and act as a positive stop to further movement.

The rope locking action is released by applying a pulling force on the wire cable 22 which in turn is connected to the spring 28 and rotates the two cam detents 24,25 inwardly thus releasing them from the rope 17. Once the cam detents 24,25 have been released the surface 31 is free to slide along the rope 17 but the rope cannot fall away from the locking device 20 because the surface 31 is curved providing insufficient space for the rope to fall out, however, if desired the rope may be pulled out of the locking device so that it is permanently disengaged.

The mounting plate 23 is designed to have two mounting screws 34 and 35 on the center line of the plate 23 to allow for mounting the locking device 20 on very narrow tiller arms or on tiller arms having oval or round cross sections.

The geometry of the spring 28 is such that the pull on cable 22 required to hold the cam detents 24,25 in the fully retracted position is much less than that required for the initial disengagement. Thus, the holding of the locking device in the release position for long periods requires relatively little effort.

The control lever 21 is positioned directly beneath the end of the tiller arm 12 so that the helmsman's fingers may easily stretch around the control lever and by squeezing may release the locking device 20, thus allowing the locking device 20 to slide with respect to the rope 17. The movement of the control lever 21 is similar to that of the brake on a bicycle. The control lever 21 pivots about pivot 37 which pulls on a cylindrical cast metal end 38 formed integral with the wire cable 22. The cable 22 passes around a pulley 39, thus when the lever 21 is depressed the cable 22 is pulled releasing the locking device 20. When the lever 21 is released the spring 28 of the locking device 20 pulls the cable 22 and thus returns the lever 21 to its original position. At the same time the two cam detents 24,25 engage the rope 17.

In operation the helmsman can lock and unlock the locking device 20 as quickly and as often as he can open and close his hand. This facility allows him to make instantaneous and infinitely variable tiller position corrections while he is at his steering station, any of which tiller positions are automatically retained should he have to leave his station for a short period. This facility also allows him to steer without expending much effort even when rudder forces are very high. The only time he experiences the full force of the rudder is when he unlocks the tiller arm to make a course correction.

The lever arm 21 is supported in a bracket 40 and mounted on the underside of the tiller arm 12 by screws 41 and 42 which are on the center line to allow for ease of mounting on circular cross sectional tiller arms.

A locking pin 43 is provided for holding the control lever 21 in the closed position should the helmsman wish to retain control of the tiller for a long period of time and without having to continually depress the control lever 21. The locking pin 43 when pressed in with the control lever 21 depressed fits into a circular depression 44 on the control lever 21 thus holding the control lever 21 depressed and the cable 22 taut. The locking pin 43 is held in place by friction and a small spring 45 beneath the locking pin 43 immediately disengages the locking pin when the control lever 21 is depressed as the friction effect holding the pin 43 in place is removed.

Various changes may be made to the locking device without departing from the scope of the present invention which is limited solely by the claims. The curved restraining surface 31 may be replaced by a series of rollers. A nylon rope having good elasticity is preferred. The nature of the surface of the rope, softness, coefficient of friction etc. has some effect on initial cam detent engagement and on deeper engagement under tiller movement.

In another embodiment the restraining surface 31 on which the rope 17 slides may be indented to improve the gripping effect between the rope and the locking device 20.

The locking device may be used on a large range of boat sizes up to 35 feet in length which have tiller steering and not wheel steering. Some care is needed when using the locking device with small day sailers without fixed keels. In these smaller boats leaving the steering station is not advisable.

The embodiments of the invention in which an exclusive property or privilege is claimed are defined as follows:

1. A quick release locking device to hold a tiller arm of a sailing boat in any desired position, the tiller arm connected at one end to a rudder rotating about a rudder axis, the device comprising two rope attachment means, one at each side of the boat, positioned an equi-distance from the rudder axis, rope locking means located on the underside of the tiller arm including two opposing cam detents, one cam detent pressing the rope against a restraining surface to grip the rope and prevent the tiller arm from moving in one direction, and the other cam detent pressing the rope against the restraining surface to grip the rope and prevent the tiller arm from moving in the other direction, spring means forcing each cam detent to press and grip the rope against the restraining surface, flexible rope tautly strung between the two attachment means passing through the rope locking means, quick release control lever located on the tiller arm, and connection means between the control lever and the rope locking means and joining the spring means to the control lever, the connection means adapted to retract the cam detents from pressing and gripping the rope such that depression of the control lever releases the rope from the rope locking means allowing the tiller arm to be rotated as desired, and release of the control lever grips the rope in the rope locking means preventing the tiller arm from rotating.

2. The device according to claim 1 including a locking pin for holding the control lever in a depressed position such that the rope locking means is free to slide with respect to the rope.

3. The device according to claim 1 wherein the connection means includes a wire cable attached between the spring means and the quick release control lever.

4. The device according to claim 1 wherein the restraining surface is curved to the circumference of the rope so that the restraining surface is free to slide but the rope is retained between the restraining surface and the two cam detents when the control lever is depressed.

5. The device according to claim 1 wherein the flexible rope is made from nylon.

* * * * *